US011625055B2

(12) United States Patent
Azevedo et al.

(10) Patent No.: US 11,625,055 B2
(45) Date of Patent: Apr. 11, 2023

(54) PROGRAMMABLE TWO-WAY FAST DVC CONTROL CIRCUIT

(71) Applicant: Dialog Semiconductor (UK) Limited, London (GB)

(72) Inventors: Carlos Azevedo, Swindon (GB); Ambreesh Bhattad, Swindon (GB); Frank Kronmueller, Neudenau (DE); Mahir Uka, Ulm (DE); Benedikt Wolf, Kirchheim unter Teck (DE)

(73) Assignee: Dialog Semiconductor (UK) Limited, London (GB)

( * ) Notice: Subject to any disclaimer, the term of this patent is extended or adjusted under 35 U.S.C. 154(b) by 115 days.

(21) Appl. No.: 16/373,896

(22) Filed: Apr. 3, 2019

(65) Prior Publication Data

US 2020/0278709 A1 Sep. 3, 2020

(30) Foreign Application Priority Data

Mar. 1, 2019 (DE) ..... 102019202853.5

(51) Int. Cl.
*G05F 1/575* (2006.01)

(52) U.S. Cl.
CPC ..... *G05F 1/575* (2013.01)

(58) Field of Classification Search
CPC ..... G05F 1/575
USPC ..... 323/273
See application file for complete search history.

(56) References Cited

U.S. PATENT DOCUMENTS

| | | | | |
|---|---|---|---|---|
| 7,342,328 | B1 * | 3/2008 | Eddleman | H02J 1/10 307/80 |
| 2007/0216383 | A1 | 9/2007 | Al-Shyoukh et al. | |
| 2014/0210430 | A1 | 7/2014 | Bhattad et al. | |
| 2014/0266100 | A1 | 9/2014 | Cavallini et al. | |
| 2014/0266103 | A1 * | 9/2014 | Wang | G05F 1/565 323/275 |

(Continued)

FOREIGN PATENT DOCUMENTS

| | | |
|---|---|---|
| DE | 10 2016 204 571 | 9/2017 |
| EP | 2 952 996 | 12/2015 |

OTHER PUBLICATIONS

German Office Action, File No. 10 2019 202 853.5, Applicant: Dialog Semiconductor (UK) Limited, dated Oct. 18, 2019, 8 pages and English language translation, 7 pages.

*Primary Examiner* — Harry R Behm
(74) *Attorney, Agent, or Firm* — Saile Ackerman LLC; Stephen B. Ackerman

(57) ABSTRACT

A linear regulator which has a pass device coupled between an input voltage level and an output node, a voltage divider circuit for generating a feedback voltage that depends on an output voltage at the output node, and an operational amplifier for controlling the pass device, the operational amplifier receiving the feedback voltage and a reference voltage at its inputs is presented. The operational amplifier has: an input stage that receives the feedback voltage and the reference voltage at its inputs, an amplifier stage that receives an output of the input stage at its input, and a current injection circuit for sourcing current into an intermediate node between the input stage and the amplifier stage, or sinking a current from the intermediate node. The disclosure further relates to a corresponding method of operating a linear regulator.

14 Claims, 7 Drawing Sheets

(56) References Cited

U.S. PATENT DOCUMENTS

| | | | | |
|---|---|---|---|---|
| 2015/0212531 | A1* | 7/2015 | Pujol | G05F 1/573<br>323/273 |
| 2017/0060157 | A1* | 3/2017 | Jefremow | H02M 3/155 |
| 2017/0126118 | A1* | 5/2017 | Duong | G05F 1/575 |
| 2017/0177014 | A1* | 6/2017 | Kurnaz | G05F 1/575 |
| 2017/0269619 | A1* | 9/2017 | Ciomaga | G05F 1/575 |

* cited by examiner

PROGRAMMABLE TWO-WAY FAST DVC CONTROL CIRCUIT

TECHNICAL FIELD

This disclosure relates to linear regulators (e.g., low dropout regulators (LDOs)) and to corresponding methods of operating linear regulators. The disclosure particularly relates to linear regulators with fast dynamic voltage control (DVC) capability.

BACKGROUND

With the increasing trend in wearables, internet-of-things, and mobile devices, energy efficiency is a critical requirement and must be kept as high as possible in order to extend the battery lifetime of such devices. Consequently, better power management systems capable of managing the power consumption of these devices are required. For example, the power consumption can be managed by decreasing the supply voltage of digital blocks or by turning off blocks under certain circumstances.

One way to achieve this is by effectively managing the power consumption of the system at hand by dynamically controlling the voltage delivered to the load of the system by means of the DVC technique. This can help the system to switch between power states as demanded by the main CPU and therefore reduce the overall power consumption and dissipation when required.

However, the Miller capacitance (Miller capacitor) of operational amplifiers used for the DVC may slow the transitions between the different power states, which will eventually result in less pronounced power savings than could be achieved by the DVC.

SUMMARY

There is a need for improved linear regulators with DVC capability. There is particular need for linear regulators with faster transition rates between different power states. There is further need for corresponding methods of operating such linear regulators.

In view of some or all of these needs, the present disclosure proposes a linear regulator and a method of operating a linear regulator, having the features of the respective independent claims.

An aspect of the disclosure relates to a linear regulator. The linear regulator may be an LDO, for example. Further, the linear regulator may have DVC capability. The linear regulator may include a pass device coupled between an input voltage level and an output node. The linear regulator may further include a voltage divider circuit for generating a feedback voltage that depends on an output voltage at the output node. The voltage divider circuit may be a (programmable) resistor string, for example. The linear regulator may yet further include an operational amplifier for controlling the pass device. The operational amplifier may receive the feedback voltage and a reference voltage at its inputs. The reference voltage may be a (fixed) reference voltage for the feedback voltage. The operational amplifier may include an input stage (first stage) that receives the feedback voltage and the reference voltage at its inputs. The input stage may be a transconductance (gm) stage for converting a voltage differential at its inputs to a current. The operational amplifier may further include an amplifier stage (second stage) that receives an output of the input stage at its input. The operational amplifier may include more than two stages in some implementations. The operational amplifier may yet further include a current injection circuit for sourcing current into an intermediate node between the input stage and the amplifier stage, or sinking a current from the intermediate node. The purpose of the current that is injected (e.g., sourced or sunk) by the current injection circuit may be to compensate for current flowing through the Miller capacitance of the amplifier stage.

Configured as described above, the linear regulator is capable of very fast DVC. That is, the linear regulator is capable of scaling the voltage delivered to the load up or down at a very high rate and of supporting load transients during the voltage scaling process. Quickly reacting to changes in the required load also contributes to reducing overall power consumption. Moreover, by implementing the linear regulator described above the silicon area can be reduced (compared to conventional linear regulators with similar capabilities).

In some embodiments, the current injection circuit may include a controllable current source for sourcing a current into the intermediate node and/or a controllable current sink for sinking a current from the intermediate node. The controllable current source and the controllable current sink may have adjustable current values. The adjustment may be performed in discrete steps or may be a linear (i.e., continuous) adjustment. For example, the controllable current source and the controllable current sink may be current digital-to-analog converters (current DACs or iDACs). Using controllable current sources, such as iDACs, allows to appropriately and accurately compensate for any current flowing through the Miller capacitance of the operational amplifier. Thereby, a stable operating point of the amplifier stage of the operational amplifier can be ensured, thus improving overall speed of the operational amplifier.

In some embodiments, the current injection circuit may be controlled in such manner that it sinks current from the intermediate node during ramp-up of the output voltage. In some embodiments, the current injection circuit may be controlled in such manner that it sources current to the intermediate node during ramp-down of the output voltage. Thereby, the current flowing through the Miller capacitance of the operational amplifier can be compensated for so that it does not impact the operating point of the amplifier stage of the operational amplifier.

In some embodiments, the voltage divider circuit may have a variable divider ratio. In this case, the current injection circuit may be jointly controlled with the voltage divider circuit. For example, the (variable) divider ratio R may be defined such that $V_{FB}=K\cdot V_{OUT}$ (with $K\leq 1$). Accordingly, the current injection circuit works in conjunction with the voltage divider circuit. Since the current flowing through the Miller capacitance of the operational amplifier depends on a change of the output voltage of the linear regulator, this allows for very fast compensation of said current.

In some embodiments, the voltage divider circuit may include a variable resistance element that is arranged such that varying a resistance of the variable resistance element changes a divider ratio of the voltage divider circuit.

In some embodiments, the current injection circuit and the variable resistance element may operate under control of the same control signal. That is, the current injection circuit and the variable resistance element (or the voltage divider circuit, for that matter) can be said to operate under joint control.

In some embodiments, the current injection circuit and the variable resistance element may be jointly controlled such that the current injection circuit sources current to the intermediate node when the divider ratio is increased. A larger divider ratio (feedback ratio) K corresponds to a ramp-down of the output voltage. In this case, the current flowing through the Miller capacitance, away from an input of the amplifier stage, can be compensated by sourcing a current to the input of the amplifier stage.

In some embodiments, the current injection circuit and the variable resistance element may be jointly controlled such that the current injection circuit sinks current from the intermediate node when the divider ratio is decreased. A smaller divider ratio (feedback ratio) K corresponds to a ramp-up of the output voltage. In this case, the current flowing through the Miller capacitance, into from an input of the amplifier stage, can be compensated by sinking a current from the input of the amplifier stage.

Another aspect of the disclosure relates to a method of operating a linear regulator. The linear regulator may include a pass device coupled between an input voltage level and an output node. The linear regulator may further include a voltage divider circuit for generating a feedback voltage that depends on an output voltage at the output node. The linear regulator may yet further include an operational amplifier for controlling the pass device. The operational amplifier may receive the feedback voltage and a reference voltage at its inputs. Further, the operational amplifier may include an input stage that receives the feedback voltage and the reference voltage at its inputs. The operational amplifier may also include an amplifier stage that receives an output of the input stage at its input. The method may include sourcing a current into an intermediate node between the input stage and the amplifier stage, and/or sinking a current from the intermediate node.

In some embodiments, the current may be sourced into the intermediate node by a controllable current source for sourcing the current into the intermediate node and/or the current may be sunk from the intermediate node by a controllable current sink for sinking the current from the intermediate node. The controllable current source and the controllable current sink may have adjustable current values. The adjustment may be performed in discrete steps or may be a linear (i.e., continuous) adjustment. For example, the controllable current source and the controllable current sink may be iDACs.

In some embodiments, the method may include sinking current from the intermediate node during ramp-up of the output voltage. In some embodiments, the method may include sourcing current to the intermediate node during ramp-down of the output voltage.

In some embodiments, the voltage divider circuit may have a variable divider ratio. In this case, the method may include jointly controlling the voltage divider circuit and a current injection circuit for sourcing or sinking of the current.

In some embodiments, the voltage divider circuit may include a variable resistance element that is arranged such that varying a resistance of the variable resistance element changes a divider ratio of the voltage divider circuit.

In some embodiments, the method may include operating the variable resistance element and a current injection circuit for sourcing or sinking of the current under control of the same control signal.

In some embodiments, the method may include sourcing current to the intermediate node when the divider ratio is increased.

In some embodiments, the method may include sinking current from the intermediate node when the divider ratio is decreased.

It will be appreciated that method steps and apparatus features may be interchanged in many ways. In particular, the details of the disclosed method can be implemented as an apparatus (circuit) adapted to execute some or all or the steps of the method, and vice versa, as the skilled person will appreciate. In particular, it is understood that methods according to the disclosure relate to methods of operating the circuits according to the above embodiments and variations thereof, and that respective statements made with regard to the circuits likewise apply to the corresponding methods.

It is also understood that in the present document, the term "couple" or "coupled" refers to elements being in electrical communication with each other, whether directly connected e.g., via wires, or in some other manner (e.g., indirectly). Notably, one example of being coupled is being connected.

BRIEF DESCRIPTION OF THE DRAWINGS

Example embodiments of the disclosure are explained below with reference to the accompanying drawings, wherein like reference numbers indicate like or similar elements, and wherein FIG. 1 schematically illustrates an example of a linear regulator.

DESCRIPTION

As indicated above, identical or like reference numbers in the disclosure indicate identical or like elements, and repeated description thereof may be omitted for reasons of conciseness.

Broadly speaking, the present invention involves a programmable current digital-to-analogue converter along with its respective digital implementation and control strategy. Depending on the precision, area, current and speed, a voltage- or current-based architecture can be used. Another important feature is the use of a current steering system within the DVC voltage control system to achieve very fast transitions.

In more detail, the present invention relates to a programmable fast digital voltage control in a switching or linear multi-stage amplifier or attenuator in order to overcome one or multiple high-impedance or low-impedance nodes (such as a miller capacitance) by injecting current into the respective node or steering current away from the node.

The techniques proposed by the present invention allow to speed up the transitions between power states, both from low to high and vice versa. That is, these techniques allow to achieve very fast transitions between power states when scaling the voltage delivered to the load up or down, with or without load transient. Moreover, very high voltage scaling rates can be achieved and silicon area as well as power consumption can be reduced. It is also to be noted that implementing the proposed techniques requires minimum modification to the multistage amplifier or attenuator in which they are intended to be used.

Figure 1:
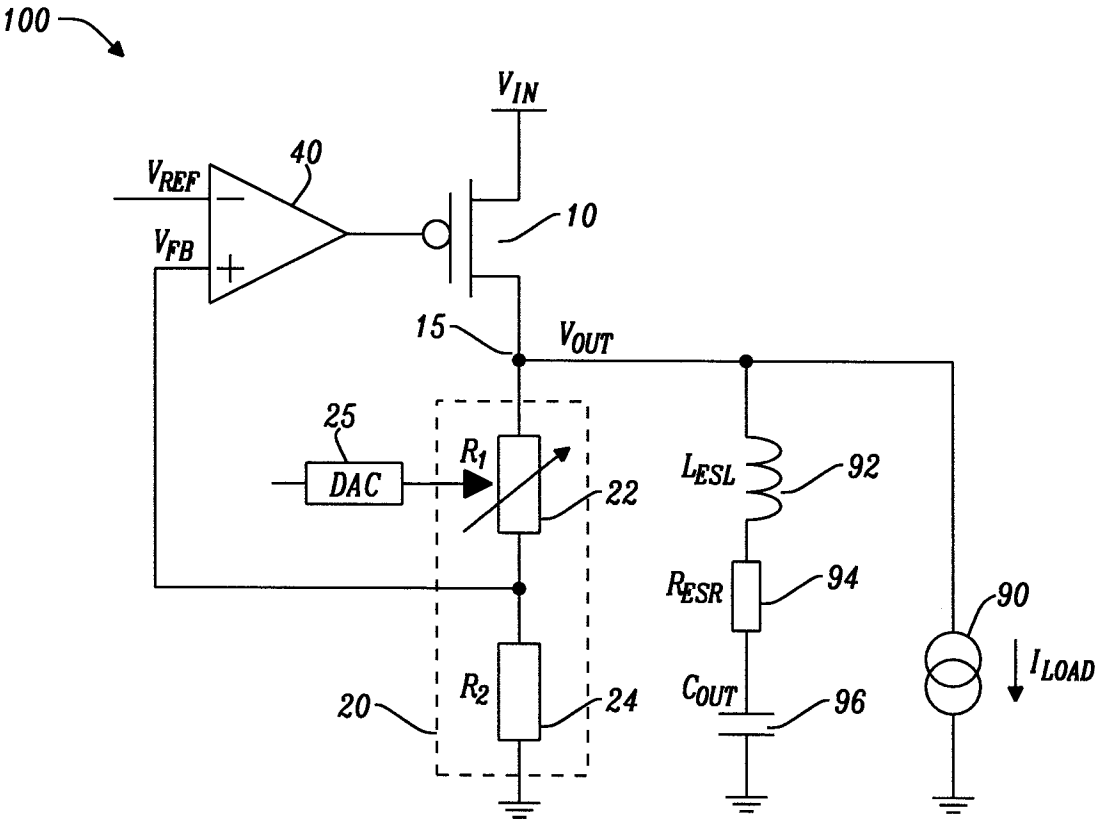

FIG. 1 schematically illustrates an example of a linear regulator 100 with DVC capability. In this example, without intended limitation, a multi-stage linear amplifier, and in particular, a PMOS implementation of a LDO is shown. The linear regulator 100 comprises a pass device 10, an amplifier (e.g., operational amplifier) 40 for controlling (a control terminal, e.g., gate, of) the pass device 10, and a voltage divider circuit 20 for generating a feedback voltage $V_{FB}$ for the operational amplifier 40. The pass device 10 is coupled (e.g., connected) between an input voltage level $V_{IN}$ (e.g., at an input node of the linear regulator 100) and an output node 15 of the linear regulator 100. The output node 15 can be coupled to an output load 90.

The operational amplifier 40 receives the feedback voltage $V_{FB}$ at one of its inputs (e.g., the non-inverting input) and receives a reference voltage $V_{REF}$ (e.g., fixed reference voltage) for the feedback voltage $V_{FB}$ at the other one of its inputs (e.g., the inverting input). An output of the operational amplifier 40 is coupled to the control terminal of the pass device 10.

The feedback voltage $V_{FB}$ is generated by the voltage divider circuit 20 to depend on an output voltage $V_{OUT}$ at the output node 15. The voltage divider circuit 20 has a variable divider ratio (feedback ratio) K that determines the feedback voltage $V_{FB}$ in dependence on the output voltage $V_{OUT}$, via $V_{FB}=K \cdot V_{OUT}$. In one implementation, the voltage divider circuit 20 may be a programmable resistor string. The programmable resistor string comprises a string of at least two resistance elements 22, 24 (e.g., resistors). Among the resistance elements is a variable resistance element 22. The other resistance element(s) 24 may have fixed resistances. The variable resistance element 22 is arranged such that varying a resistance of the variable resistance element 22 changes the divider ratio K of the voltage divider circuit 20. For example, the feedback voltage $V_{FB}$ may be tapped at an intermediate node between the variable resistance element 22 and the other resistance element(s) 24. In this example implementation, decreasing the resistance of the variable resistance element 22 will increase the divider ratio K, whereas increasing the resistance will decrease the divider ratio K. The variable resistance element 22 (i.e., its resistance) may be controlled by a DAC 25 (e.g., an 8-bit DAC) that receives a digital control signal indicating a desired resistance of the variable resistance element. The digital control signal may be provided by a control block (not shown in the figure).

The linear regulator 100 further comprises an output capacitor 96 as well as an output inductor 92 and an output resistor 94.

Not shown in FIG. 1 is a Miller capacitance (Miller capacitor) of the operational amplifier 40. The output voltage regulation in the linear regulator 100 proceeds by means of a negative feedback through the voltage divider circuit 20 (e.g., resistor string), which may be referred to as "slow-loop", and another feedback loop through the Miller capacitor, which may be referred to as "fast-loop".

Figure 2:
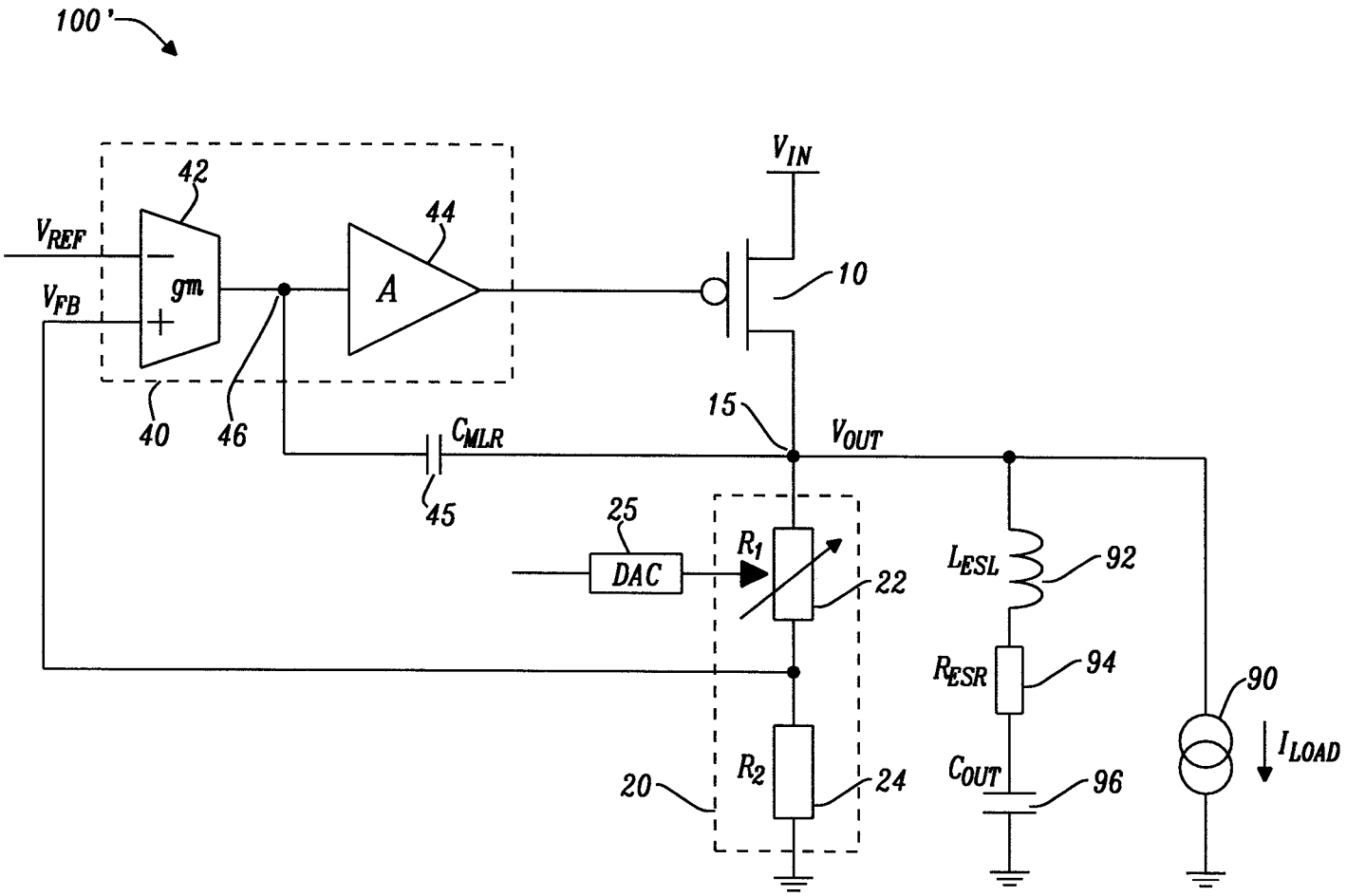
FIG. 2 schematically illustrates an example of an implementation of an operational amplifier in the linear regulator of FIG. 1.

FIG. 2 schematically illustrates an example of a linear regulator 100', showing a more detailed implementation of the operational amplifier 40. Accordingly, the operational amplifier 40 comprises an input stage 42 (first stage) and an amplifier stage 44 (second stage), with an intermediate node 46 arranged in between. The input stage 42 receives the feedback voltage $V_{FB}$ and the reference voltage $V_{REF}$ at its inputs. The input stage 42 may be a transconductance (gm) stage for converting a voltage differential at its input to a current. The amplifier stage 44 receives an output of the input stage 42 (e.g., the current produced by the input stage 42) at its input. An output of the amplifier stage 44 is provided to the control terminal (e.g., gate) of the pass device 10 for controlling the pass device 10. In some implementations, the operational amplifier 40 may comprise more than two stages.

In such case, a current injection circuit as described above may be provided for each Miller capacitance of the operational amplifier.

Also shown in FIG. 2 is the Miller capacitance 45 of the operational amplifier 40 which is formed between the intermediate node 46 and the output node 15 of the linear regulator 100.

The generic PMOS LDOs shown in FIG. 1 and FIG. 2 only have an active drive-up and rely on the load 90 to pull down. For some fields of application it may be desirable to have an active pull-down as well (e.g., using transistors, resistors, etc.).

Figure 3:
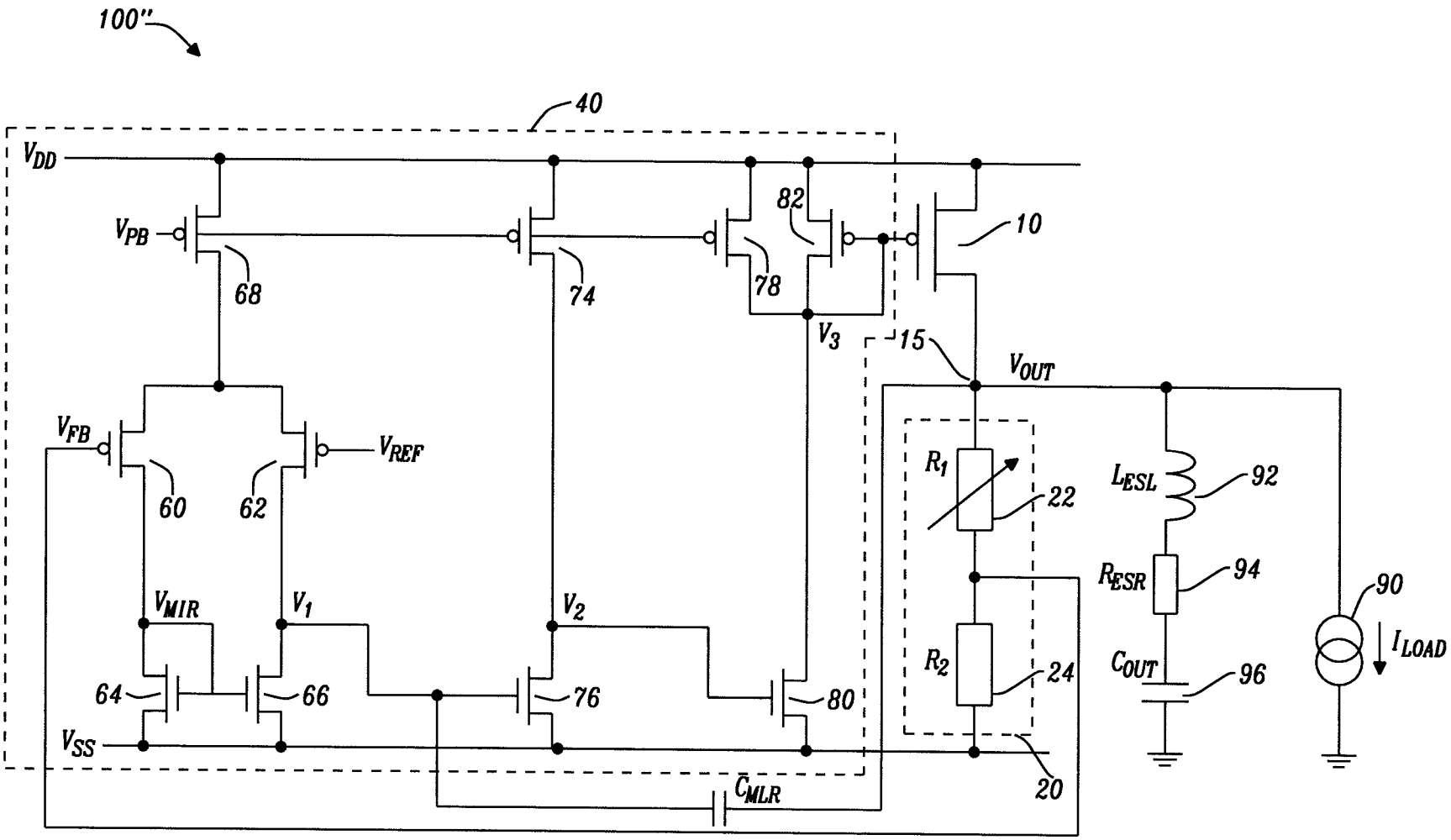
FIG. 3 schematically illustrates another example of an implementation of the operational amplifier in the linear regulator of FIG. 1.

FIG. 3 shows a linear regulator 100" that corresponds to a more detailed (i.e., transistor-level) view of the PMOS linear regulators of FIG. 1 and FIG. 2. The linear regulator 100" differs from the linear regulators 100 and 100' in that it shows a transistor-level implementation of the operational amplifier 40. The other elements of linear regulator 100" may be identical to corresponding ones in linear regulators 100, 100'.

The operational amplifier 40 of the linear regulator 100" comprises a first transistor device 60 for receiving the feedback voltage $V_{FB}$ at its control terminal (e.g., gate) and a second transistor device 62 for receiving the reference voltage $V_{REF}$ at its control terminal (e.g., gate). The operational amplifier 40 further comprises third and fourth transistor devices 64, 66 that form a current mirror. The first and second transistor devices 60, 62 are coupled in parallel, each in series with a respective one of the third and fourth transistor devices 64, 66. The assembly of the first to fourth transistor devices 60, 62, 64, 66 is coupled in series with a fifth transistor device 68 between $V_{DD}$ and $V_{SS}$. Optionally, a sixth transistor device and a seventh transistor device (not shown in the figure) may be coupled in series between $V_{DD}$ and a node between the second and fourth transistor devices 62, 66. A voltage $V_3$ may be applied to the control terminal (e.g., gate) of the seventh transistor device. The control terminal (e.g., gate) of the sixth transistor device may be is coupled to the control terminal of the fifth transistor device 68, to which a voltage $V_{PB}$ is applied. Further, a string of an eighth transistor device 74 and a ninth transistor device 76, and a string of a tenth transistor device 78 and an eleventh transistor device 80 are coupled in parallel between $V_{DD}$ and $V_{SS}$. Control terminals (e.g., gates) of the eighth and tenth transistor devices 74, 78 are coupled to the control terminal of the fifth transistor device 68. A twelfth transistor device 82 is coupled in parallel to the tenth transistor device 78, with its control terminal (e.g., gate) coupled to an output terminal (e.g., drain in the present PMOS example) of the tenth transistor device 78. The control terminal of the twelfth transistor device 82 corresponds to the output of the operational amplifier 40 and is coupled to the control terminal of the pass device 10. The Miller capacitance 45 is formed between the output node 15 of the linear regulator 100" and the aforementioned node (intermediate node) between the second and fourth transistor devices 62, 66. The first to fourth transistor devices 60, 62, 64, 66, 68 may correspond to (or form) the input stage 42 of the operational amplifier 40. The string of the eighth and ninth transistor devices 74, 76 may correspond to (or form) the amplifier stage 44 of the operational amplifier 40.

One challenge when performing a DVC operation (e.g., in the linear regulators described above) is to cope with the large capacitance at the output of the first stage (input stage) of the operational amplifier due to the Miller effect. This capacitance will be referred to as Miller capacitance or Miller capacitor throughout this disclosure. The slew-rate of the DVC will be defined by how fast the output node of the first stage can change, since, for stability reasons, this node is designed to be very slow, or in other words, to be the dominant pole in the system.

The present invention proposes to have a current injection circuit (e.g., current DAC) connected to the output of the first stage of the operational amplifier to compensate for the current flowing through the Miller capacitor when the output voltage is being dynamically scaled up or down. This way it can be ensured that the operating point at the output of the first stage and at the input of the second stage is kept constant while the linear regulator (e.g., LDO) is dynamically changing the voltage at its output.

Depending on the DVC rate, the source currents and sink currents for the Miller capacitance must be programmed in a way to satisfy the desired slew-rate. That is, the current injection circuit (e.g., iDAC) must be designed in a way to satisfy the desired slew-rate of the output voltage of the linear regulator. This can be achieved by considering the basic capacitor equation: $I_c = C_{Miller} * \Delta V_c / \Delta t$, where $\Delta V_c$ is the voltage across the capacitor plates, $\Delta t$ is the DVC time, and $C_m$ is the capacitance of the Miller capacitor.

Figure 4:
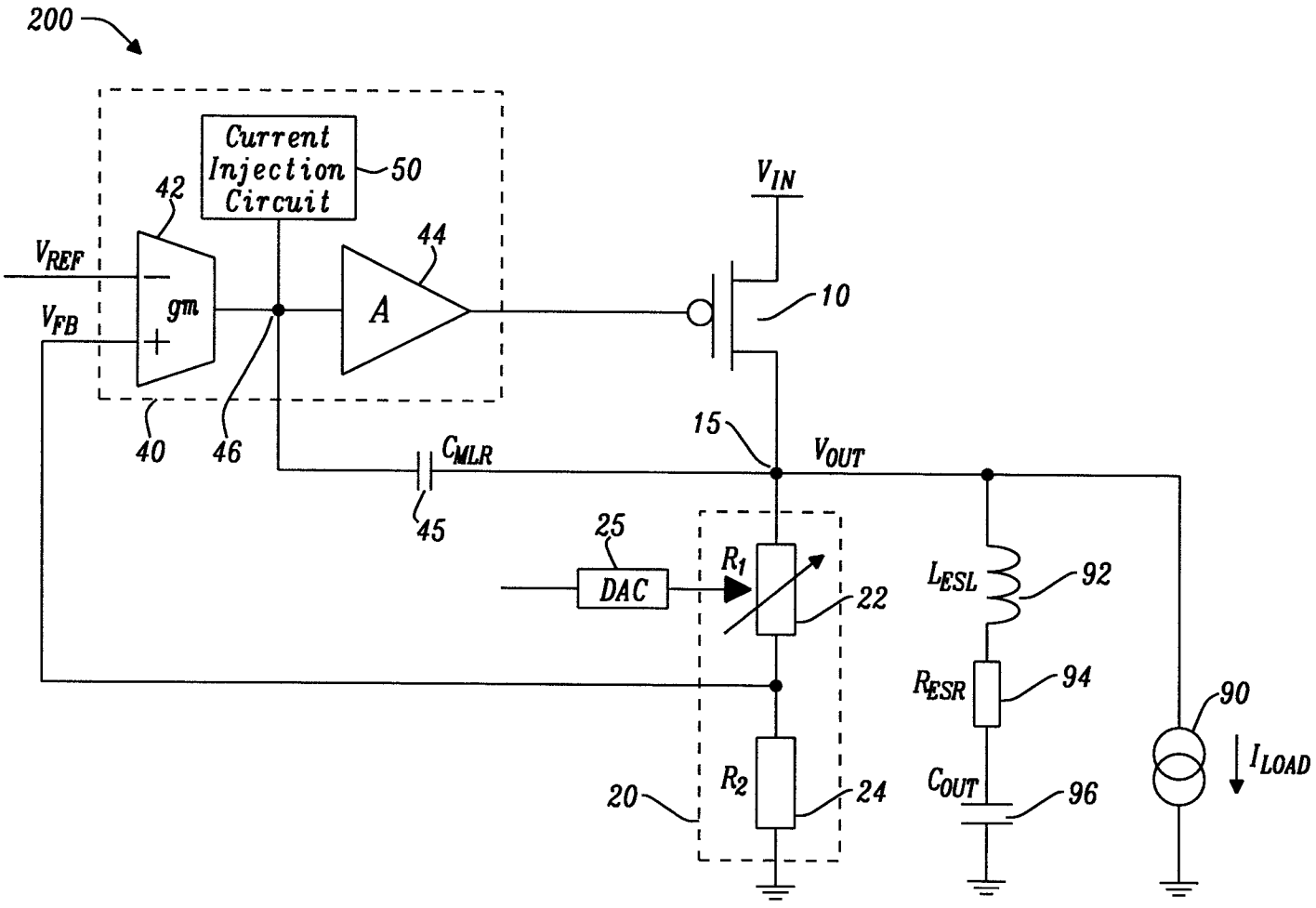
FIG. 4 schematically illustrates an example of a linear regulator according to embodiments of the disclosure.

FIG. 4 illustrates a schematic view of a linear regulator 200 (e.g., LDO) that implements techniques according to embodiments of the disclosure. The linear regulator 200 differs from the linear regulator 100' in that it additionally comprises a current injection circuit 50 that is coupled to the intermediate node 46 of the operational amplifier 40, between the input stage 42 and the amplifier stage 44. The current injection circuit 50 can source a current to the intermediate node 46 and sink a current from the intermediate node 46 (one at a time). The purpose of the current injected (e.g., sourced or sunk) by the current injection circuit 50 is to compensate for a current flowing through the Miller capacitance 45 of the amplifier stage 44 into or out of the intermediate node 46. In some implementations, the current injection circuit 50 cooperates with the programmable voltage divider circuit 20.

In particular, the current injection circuit 50 is controlled in such manner that it sinks current from the intermediate node 46 during ramp-up of the output voltage $V_{OUT}$. Likewise, the current injection circuit 50 is controlled in such manner that it sources current to the intermediate node 46 during ramp-down of the output voltage 46. At this, a time sequence between commencing scaling of the output voltage $V_{OUT}$ and commencing current injection is not of particular importance. It is sufficient in embodiments of the disclosure that current injection is performed during the scaling of the output voltage $V_{OUT}$.

Ramp-up of the output voltage $V_{OUT}$ may correspond to a decrease of the divider ratio K (feedback ratio) of the voltage divider circuit 20. Ramp-down of the output voltage $V_{OUT}$ may correspond to an increase of the divider ratio K of the voltage divider circuit 20.

Preferably, the current injection circuit 50 is jointly controlled with the voltage divider circuit 20 (e.g., the variable resistance element 22). For example, the current injection circuit 50 and the voltage divider circuit 20 (e.g., the variable resistance element 22) may operate under control of the same (digital) control signal. In line with the above considerations pertaining to the divider ratio K, the current injection circuit 50 and the variable resistance element 22 are jointly controlled such that the current injection circuit 50 sources current to the intermediate node 46 of the operational amplifier 40 when the divider ratio K is increased. On the other hand, the current injection circuit 50 and the voltage divider circuit 20 (e.g., the variable resistance element 22) are jointly controlled such that the current injection circuit 50 sinks current from the intermediate node 46 when the divider ratio K is decreased. The linear regulator may include a control block (not shown in the figures) for implementing this joint control. The control block may be coupled to the current injection circuit 50 and the voltage divider circuit 20 (e.g., the variable resistance element 22) and may issue a (digital) control signal to each of the current injection circuit 50 and the voltage divider circuit 20.

To implement the current injection capability, the current injection circuit 50 can include a controllable current source for sourcing a current into the intermediate node 46 and a controllable current sink for sinking a current from the intermediate node 46, respectively. Therein, it is understood that only one of the controllable current source and the controllable current sink is active at a time. Moreover, the controllable current source and the controllable current sink are understood to have adjustable current values that are adjusted under control of a control signal (e.g., a digital control signal). This adjustment can be performed in discrete steps or can be linear (i.e., continuous).

The current injection circuit 50 can be implemented as a current digital-to-analog converter. The current digital-to-analog converter can in turn be implemented using any of the known DACs architectures, such as like binary weighted DAC, current steering DAC, etc., for example. In some implementations, the controllable current source and the controllable current sink of the current injection circuit 50 can be iDACs.

Figure 7:
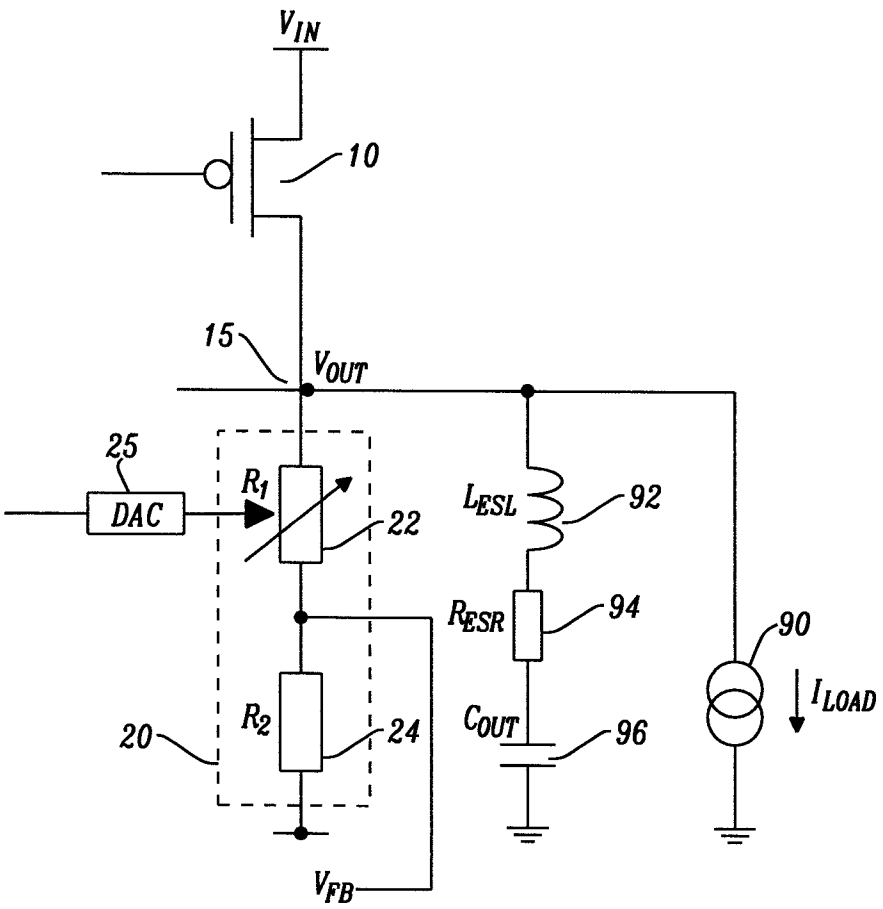
FIG. 7 schematically illustrates an example of an implementation of a voltage divider circuit in linear regulators according to embodiments of the disclosure.

As noted above, the voltage divider circuit 20 can be implemented by a resistor string or resistor ladder. The resistor ladder can be of any type, such as binary weighted, R-2R ladder, segmented ladder, etc., for example. A combination of the implementations of the current injection circuit 50 and the voltage adjustment circuit 20 can be used to balance the advantages and disadvantages of the mentioned architectures. The choice of the architecture and control may be based on requirements as to precision, area, current consumption, and speed, for example. For the sake of simplicity, examples discussed in the present disclosure use, without intended limitation, a fully segmented binary weighted resistor string in a linear regulator (e.g., LDO). Such resistor string is schematically illustrated in the example of FIG. 7, which shows a detail of the linear regulator illustrated, e.g., in FIG. 1.

Figure 5:
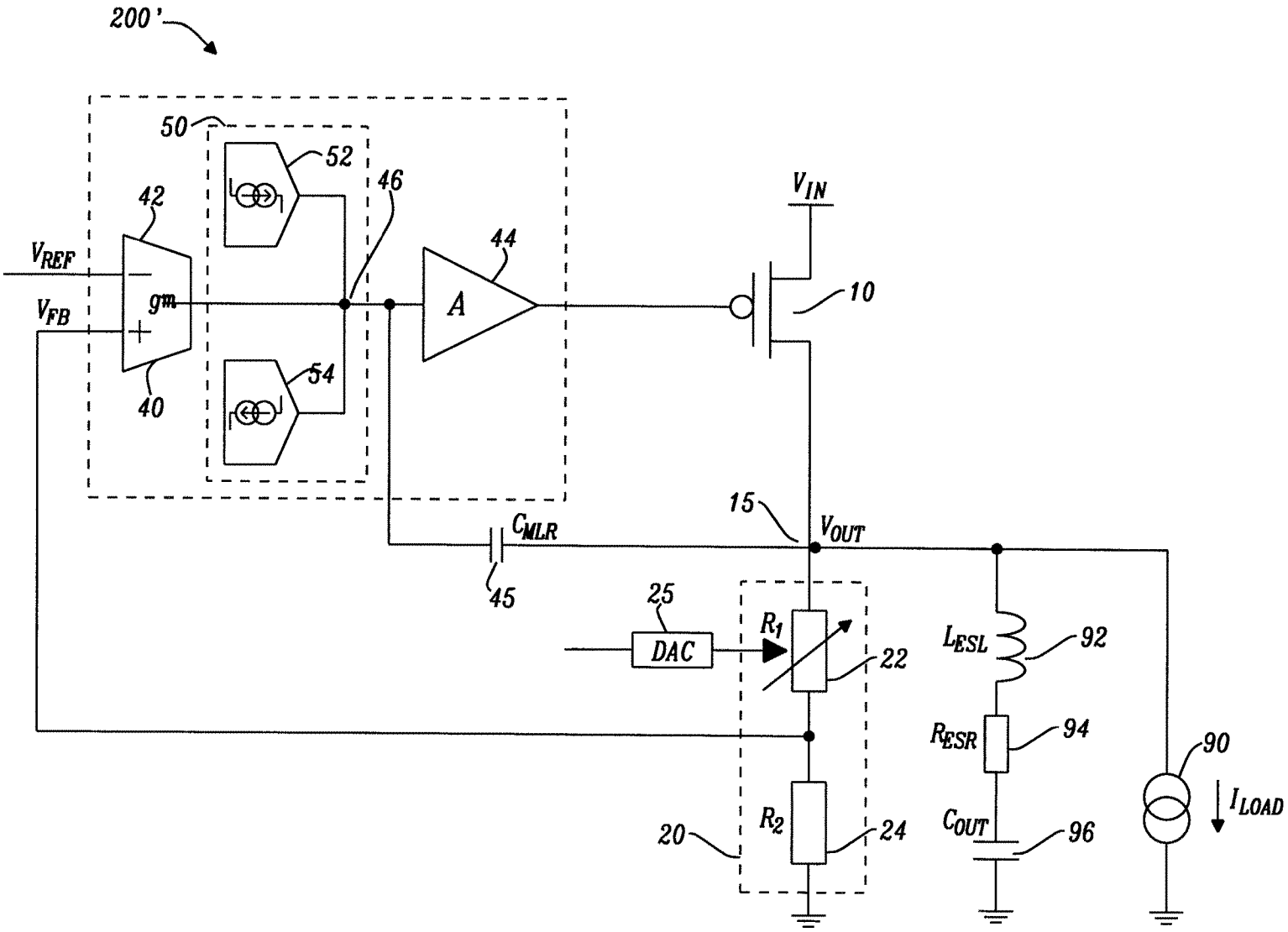
FIG. 5 schematically illustrates an example of an implementation of a current injection circuit in the linear regulator of FIG. 4, according to embodiments of the disclosure.

A specific example implementation of the current injection circuit 50 is schematically illustrated in FIG. 5. The linear regulator 200' shown in this figure may be identical to the linear regulator 200 of FIG. 4, apart from the implementation of the current injection circuit 50. In this example, the current injection circuit 50 comprises a first iDAC 52 acting as the programmable current source and a second iDAC 54 acting as the programmable current sink. Both iDACs are coupled to the intermediate node 46 of the operational amplifier 40. The iDACs may operate under control of a (digital) control signal.

Figure 6:
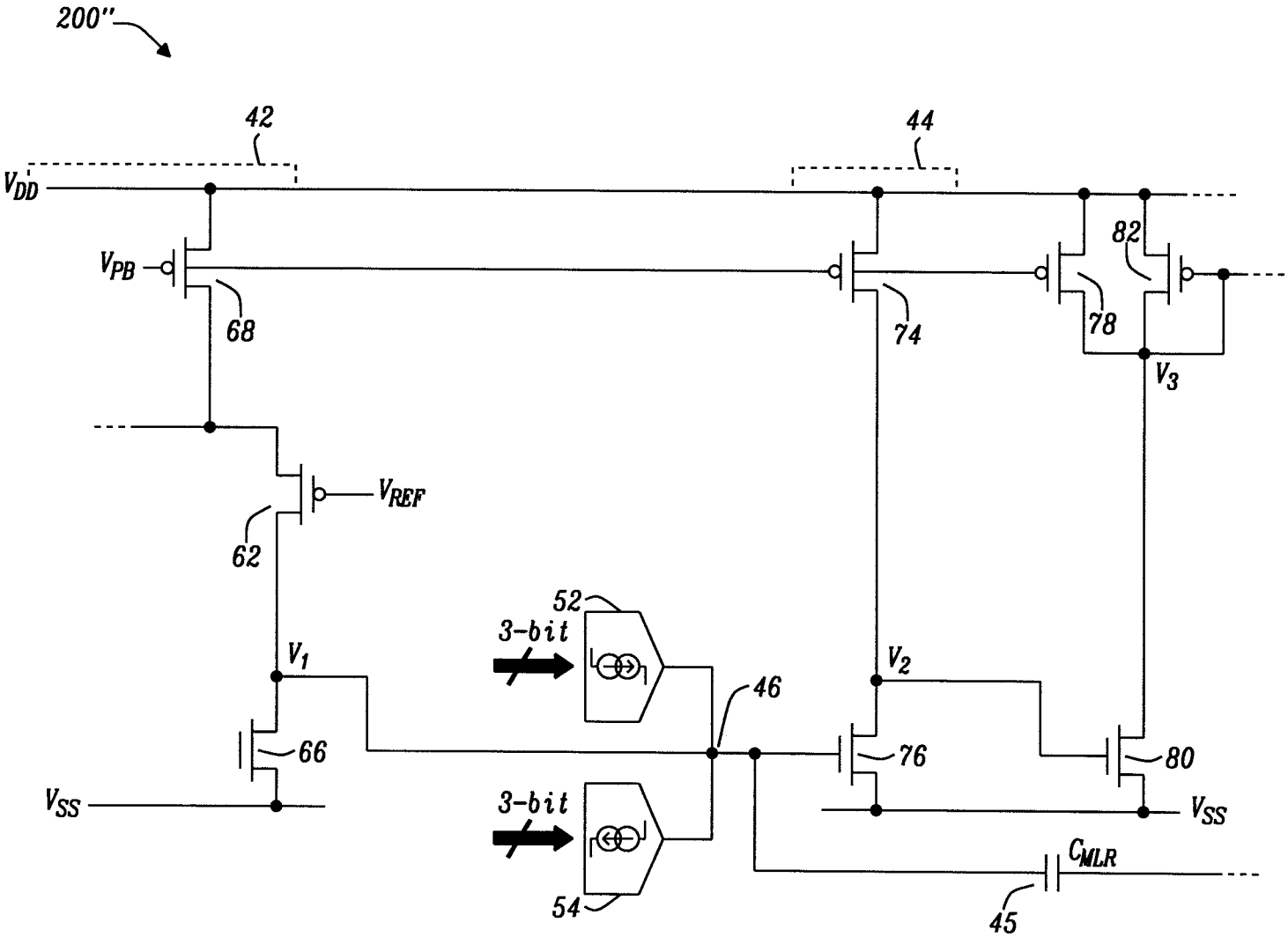
FIG. 6 schematically illustrates another example of a linear regulator according to embodiments of the disclosure.

FIG. 6 shown a section of a linear regulator 200" that corresponds to a more detailed (transistor-level) view of the PMOS linear regulators of FIG. 4 and FIG. 5. Apart from the fact that it includes the current injection circuit 50, the linear regulator 200" may be identical to the linear regulator 100" illustrated in FIG. 3, and repeated discussion of elements thereof may be omitted for the sake of conciseness. This figure also illustrates the input stage 42 and the amplifier stage 44 of the operational amplifier 40 in terms of the transistor devices forming the respective stages.

The present disclosure also relates to a corresponding method of controlling a linear regulator. The linear regulator may be configured as described above, i.e., it may comprise the pass device 10 coupled between the input voltage level $V_{IN}$ and the output node 15, the voltage divider circuit 20 for generating the feedback voltage $V_{FB}$ that depends on the output voltage $V_{OUT}$ at the output node 15, and the operational amplifier 40 for controlling the pass device 10. As above, the operational amplifier 40 receives the feedback voltage $V_{FB}$ and the reference voltage $V_{REF}$ at its inputs and comprises the input stage 42 that receives the feedback voltage $V_{FB}$ and the reference voltage $V_{REF}$ at its inputs and the amplifier stage 44 that receives an output of the input stage 42 at its input. For operating such linear regulator, the method comprises sourcing a current into an intermediate node between the input stage and the amplifier stage, or sinking a current from the intermediate node.

Further details and implementations of the proposed method become apparent from the above description of linear regulators according to embodiments of the disclosure. It is understood that functionalities of the elements of the linear regulators described above readily translate into respective method steps of operating these linear regulators.

Transient simulations were performed to prove the concept of this invention. Simulations have been performed for both DVC up and down and at two different slew-rates: 20 mV/μs and 25 mV/μs with 4 steps and 16 steps. In addition to this, a load step was simulated during DVC up to prove that DVC is maintained even if the linear regulator (e.g., LDO) experiences any sudden load transient.

In the absence of the proposed technique, a conventional linear regulator (e.g., LDO) may struggle to DVC up from, e.g., 2.5V to 3.0V. This is due to the main loop action. For example, a conventional linear regulator may take around 150 ms to go from 2.5V output voltage to 3.0V output voltage. Using the proposed technique for speeding up DVC, a linear regulator may only take 5 μs to go from 2.5V output voltage to 3.0V output voltage.

It should further be noted that the description and drawings merely illustrate the principles of the proposed circuits and methods. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed method. Furthermore, all statements herein providing principles, aspects, and embodiments of the invention, as well as specific examples thereof, are intended to encompass equivalents thereof.

What is claimed is:

1. A linear regulator, comprising:

a pass device coupled between an input voltage level and an output node;

a voltage divider circuit for generating a feedback voltage that depends on an output voltage at the output node; and an operational amplifier for controlling the pass device, the operational amplifier receiving the feedback voltage and a reference voltage at its inputs, wherein the operational amplifier comprises:

an input stage that receives the feedback voltage and the reference voltage at its inputs;

an amplifier stage that receives an output of the input stage at its input;

a current injection circuit for sourcing current into an intermediate node between the input stage and the amplifier stage, or sinking a current from the intermediate node; and a Miller capacitance that is formed between the intermediate node and the output node, wherein the current injection circuit is for compensating for current flowing through the Miller capacitance, wherein the voltage divider circuit comprises a variable resistance element that is arranged such that varying a resistance of the variable resistance element changes a divider ratio of the voltage divider circuit, and wherein the current injection circuit and the variable resistance element operate under control of the same control signal.

2. The linear regulator according to claim 1, wherein the current injection circuit comprises a controllable current source for sourcing a current into the intermediate node and/or a controllable current sink for sinking a current from the intermediate node.

3. The linear regulator according to claim 2, wherein the controllable current source and the controllable current sink are iDACs.

4. The linear regulator according to claim 1, wherein the voltage divider circuit has a variable divider ratio; and wherein the current injection circuit is jointly controlled with the voltage divider circuit.

5. The linear regulator according to claim 1, wherein the current injection circuit and the variable resistance element are jointly controlled such that the current injection circuit sources current to the intermediate node when the divider ratio is increased.

6. The linear regulator according to claim 1, wherein the current injection circuit and the variable resistance element are jointly controlled such that the current injection circuit sinks current from the intermediate node when the divider ratio is decreased.

7. The linear regulator according to claim 1, wherein the current injection circuit is controlled in such manner that it sinks current from the intermediate node during ramp-up of the output voltage.

8. The linear regulator according to claim 1, wherein the current injection circuit is controlled in such manner that it sources current to the intermediate node during ramp-down of the output voltage.

9. A method of operating a linear regulator, wherein the linear regulator comprises:

a pass device coupled between an input voltage level and an output node;

a voltage divider circuit for generating a feedback voltage that depends on an output voltage at the output node; and an operational amplifier for controlling the pass device, wherein the operational amplifier receives the feedback voltage and a reference voltage at its inputs and comprises: an input stage that receives the feedback voltage and the reference voltage at its inputs, an amplifier stage that receives an output of the input stage at its input, and a Miller capacitance that is formed between an intermediate node between the input stage and the amplifier stage and the output node, the method comprising:

sourcing a current into the intermediate node, or sinking a current from the intermediate node, for compensating for current flowing through the Miller capacitance, wherein the voltage divider circuit comprises a variable resistance element that is arranged such that varying a resistance of the variable resistance element changes a divider ratio of the voltage divider circuit, and the method further comprising:

operating the variable resistance element and a current injection circuit for sourcing or sinking of the current under control of the same control signal.

10. The method according to claim 9, wherein the current is sourced into the intermediate node by a controllable current source for sourcing the current into the intermediate node and/or the current is sunk from the intermediate node by a controllable current sink for sinking the current from the intermediate node.

11. The method according to claim 10, wherein the controllable current source and the controllable current sink are iDACs.

12. The method according to claim 9, wherein the voltage divider circuit has a variable divider ratio; and the method comprises:

jointly controlling the voltage divider circuit and a current injection circuit for sourcing or sinking of the current.

13. The method according to claim 9, comprising:

sourcing current to the intermediate node when the divider ratio is increased.

14. The method according to claim 9, comprising:

sinking current from the intermediate node when the divider ratio is decreased.

* * * * *